US005771981A

United States Patent [19]

Briggs et al.

[11] Patent Number: 5,771,981

[45] Date of Patent: Jun. 30, 1998

[54] CONTROL SYSTEM FOR PERCUSSION DRILL

[76] Inventors: Roger Robarts Briggs, 23 Leyes Lane,, Kenilworth, Warwickshire, CU8 20D, United Kingdom; Jarmo Uolevi Leppanen, c/o 11 Junction Road, Industries North, Germiston, 1401, South Africa

[21] Appl. No.: 537,774

[22] PCT Filed: Apr. 19, 1994

[86] PCT No.: PCT/GB94/00826

§ 371 Date: Oct. 20, 1995

§ 102(e) Date: Oct. 20, 1995

[87] PCT Pub. No.: WO94/24415

PCT Pub. Date: Oct. 27, 1994

[30] Foreign Application Priority Data

Apr. 21, 1993 [ZA] South Africa ..... 93/2779

[51] Int. Cl.[6] ..... E21B 44/00

[52] U.S. Cl. ..... 173/4; 173/8; 173/11; 173/141

[58] Field of Search ..... 173/2, 3, 4, 5, 173/6, 7, 8, 9, 11, 13, 141

[56] References Cited

U.S. PATENT DOCUMENTS

| | | | |
|---|---|---|---|
| 4,074,771 | 2/1978 | Morrison | 173/11 |
| 4,246,973 | 1/1981 | Mayer | 173/8 |
| 4,275,793 | 6/1981 | Schivley, Jr. et al. | 173/9 |
| 4,711,090 | 12/1987 | Hartiala et al. | 173/8 |
| 5,121,802 | 6/1992 | Rajala et al. | 173/8 |
| 5,129,464 | 7/1992 | Richier | 173/11 |
| 5,131,475 | 7/1992 | Beney | 173/11 |

*Primary Examiner*—Scott A. Smith
*Attorney, Agent, or Firm*—Spencer & Frank

[57] ABSTRACT

A control system for a percussion drill with a hydraulically actuated drill rotation mechanism and drill feed mechanism which includes a control means which operates, in response to the hydraulic pressure in the drill feed mechanism, to start percussion movement of the drill.

5 Claims, 1 Drawing Sheet

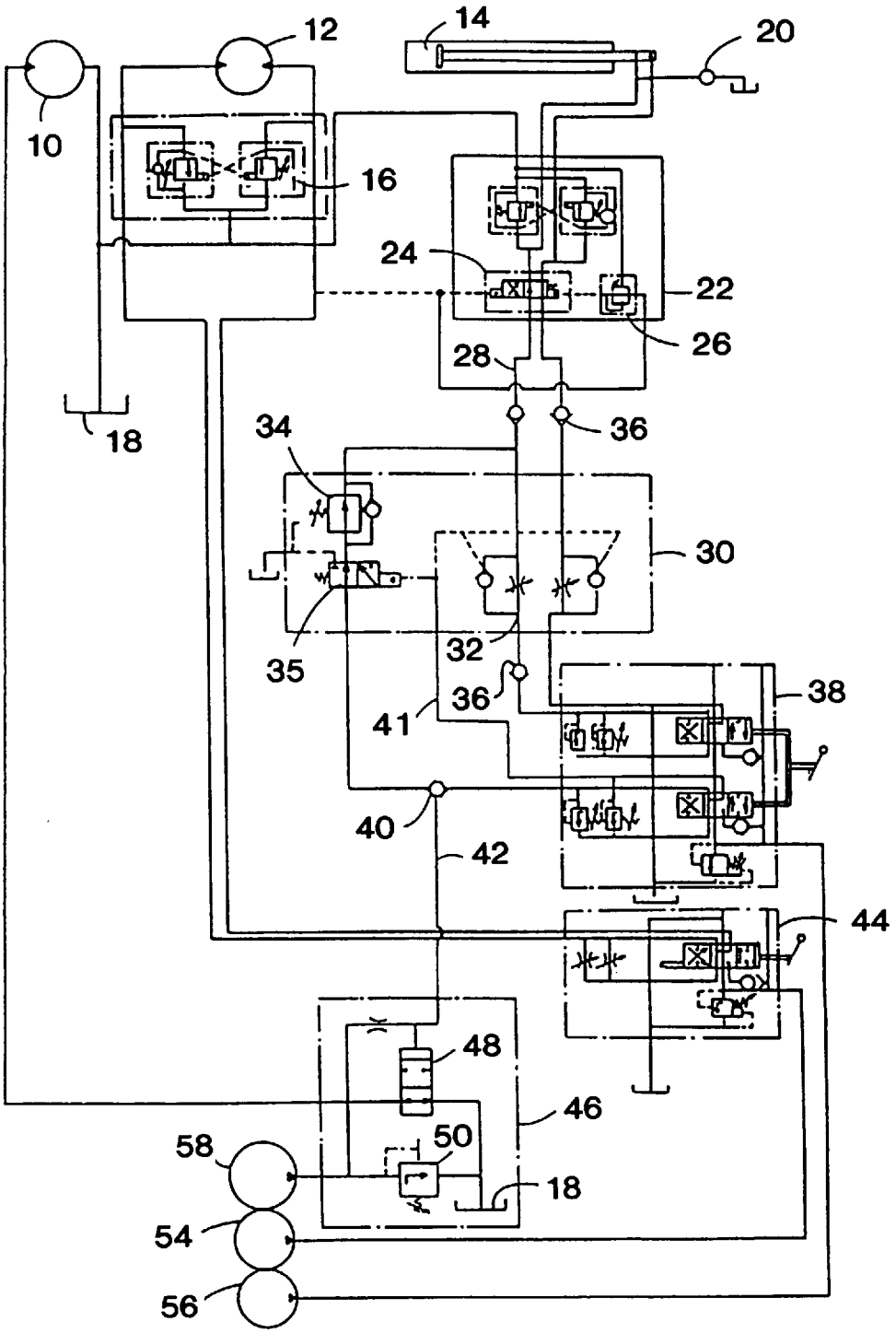
10
12
14
20
16
24
22
26
28
18
34
36
30
35
32
36
38
41
40
42
44
48
46
58
50
18
54
56

CONTROL SYSTEM FOR PERCUSSION DRILL

FIELD OF THE INVENTION

This invention relates to a control system for a percussion drill.

BACKGROUND OF THE INVENTION

A percussive drilling circuit normally includes a drilling power pack with hydraulic pumps and a power source which may either be an electric motor or a fuel driven engine, a drilling control panel with separate control valves and control means for controlling drill percussion, drill rotation and drill feed, a drill feed and a percussive hydraulic drill. The control means can be either direct control levers to operate main control valves, additional control valves and levers to pilot control the main control valves, or additional control levers for electrical piloting of the main control valves or additional control levers to operate the main valves through operating cables.

Most commonly the percussion, rotation and feed mechanisms have separate direct operated control valves and valve levers. The hydraulic fluid flow from these valves is directed through a drilling control panel.

As a large amount of hydraulic fluid for the percussion mechanism passes through the percussion control valve, in the control panel, relatively thick hydraulic hoses are required and the drilling circuit becomes complex. A complex circuit on the control panel results in an increased likelihood of oil leakages, increased maintenance, greater expense, difficulty in locating malfunctions in the circuit, and heavier demands for satisfactory operator and maintenance personnel training. A large control panel is difficult to mount ergonomically on a drilling machine without affecting the operator's visibility.

Finnish patents Nos. 86008 and 900834 describe different control systems. In the latter case the drilling feeding speed is monitored and hydraulically linked to drill rotation speed, increasing when drilling speed increases and decreasing when drilling speed drops.

The hydraulic connection optimizes the drill rotation speed with the drilling speed thereby minimizing wear of the drill bit.

In the former case the pressure ratio between drill percussion and drill feed is kept constant with an adjustable piloted displacement pump and a hydraulic circuit. The ratio between percussion power and drill feed force is kept constant. By piloting the pump the oil flow to the drill is increased or decreased in direct response to the pressure in the drill fee control circuit.

The aforementioned problems can be avoided by using a variable displacement pump and by controlling the pressure remotely, for example by means of an electric, hydraulic, pneumatic or mechanical pilot control device. However, with this kind of solution, the advantage of using a simple, cheap, dirt-tolerant, fixed displacement pump like a gear pump is lost, and the circuitry becomes complex, difficult to maintain, expensive and, due to the variable displacement pump, sensitive to dirt.

SUMMARY OF THE INVENTION

The invention provides a control system for a percussion drill with a hydraulically actuated drill rotation mechanism and a hydraulically actuated drill feed mechanism which includes control means which in reaction to the hydraulic pressure in the drill feed mechanism or in the drill rotation mechanism or both of these hydraulic pressures, operates to start a percussion movement of the drill.

In one embodiment the control means operates only in reaction to the hydraulic pressure in the drill feed mechanism and, upon starting percussive movement of the drill, simultaneously starts rotary movement of the drill.

The drill feed mechanism may be any suitable device and for example may be a drill feed cylinder.

The system may include a pump, which preferably is a fixed displacement pump such as a dirt tolerant gear pump, for supplying hydraulic fluid to a percussion mechanism of the drill, with the control means comprising valve means for directing the supply of hydraulic fluid from the pump to the percussion mechanism to start the percussion when the drill feed mechanism is pressurized.

The valve means is preferably directly connected to the pump means.

BRIEF DESCRIPTION OF THE DRAWING

The invention is further described by way of example with reference to the accompanying drawing whose single figure is a schematic illustration of a hydraulic control system for a percussion drill, according to one form of the invention.

DETAILED DESCRIPTION OF THE INVENTION

The accompanying drawing illustrates various modules and components which are identified as follows: a drill percussion mechanism 10, a drill rotation motor 12, a drill feed cylinder 14, a valve 16, a tank 18, a mechanical stop 20, an anti-jamming manifold 22 which includes a directional valve 24 and a pressure reducing valve 26, a drill feed line 28, a module 30 with a collaring flow control valve 32, a feed pressure reducing valve 34, and a pilot operated control valve 35, one-way check valves 36, a feed control valve block 38, a shuttle valve 40, pilot lines 41 and 42, a rotation control valve 44, a percussion control manifold 46 which includes a percussion control valve 48 and a relief valve 50, and fixed displacement gear pumps 52, 54 and 56 respectively for percussion, rotation and boom movement. The percussion control in manifold 46 is directly connected to the percussion pump 52 separate from the drilling control panel.

The operation of the hydraulic circuit is described hereinafter for single pass drilling with reference to various drilling modes.

Free Circulation

The accompanying diagram illustrates a situation wherein the pumps 52 to 56 are operating but with the control valves 44 and 38 in centre positions. Therefore no drilling takes place.

Hydraulic fluid is delivered by the percussion pump 52 to the pressure inlet in the percussion control manifold 46. The spool of the percussion control valve 48 is in a position at which hydraulic fluid flow is directed to the oil tank.

The rotation pump 54 delivers hydraulic fluid to the pressure inlet of the rotation control valve 44. The spool of this valve is in a centre position and consequently the valve directs fluid flow to the oil tank.

The boom pump 56 delivers hydraulic fluid to the pressure inlet of the feed control valve block 38. The spools of this valve are also in the centre position and fluid is passing to the oil tank.

Collaring

When the lever of the rotation control valve 44 is actuated the spool of the valve moves to a position at which hydraulic fluid from the rotation pump 54 is directed to the rotation motor 12.

If the lever of the feed control valve 38 is actuated then fluid from the boom pump 56 is directed through the collaring flow control valve 32, the one-way check valve 36 and the anti-jamming manifold 22 to the drill feed cylinder 14.

Percussion does not start before the drill bit comes into contact with the rock face. When the bit does contact the rock face this causes an increase in pressure in the hydraulic feed circuit which in turn activates the percussion control valve 48 closing it and starting the percussion. The percussion pressure is set to stay at a predetermined constant level with a separate pressure relief 50.

Drilling

It is necessary to release the lever of the feed control valve 38 when percussion of the drill starts. The spool of the valve, which is spring centred, then directs hydraulic fluid from the boom pump 56 back to the oil tank. At this point the percussion pump 52 takes over and supplies hydraulic fluid to the drill feed cylinder 44 through the feed pressure reducing valve 34. The percussion control valve 48 is by now fully closed and percussion runs at full power. The percussion pressure is adjusted with the relief valve 50.

The drilling can be interrupted at any moment by pressurizing the pilot line 41 with the control valve 38. The valve 35 connects the percussion control pilot line 42 to tank and turns the percussion control valve 48 on free flow to tank.

Anti-jamming

If the drill bit meets broken ground or if there is a lack of flushing or if any other unusual situation occurs, which results in a rotation pressure increase, then the connection between the rotation circuit and the anti-jamming directional valve 24 causes an immediate reversal of the drill feed cylinder 14. This results in a decrease of the rotation pressure whereupon the directional valve 24 returns to its original position and drilling recommences. The sensitivity of the anti-jamming operation can be adjusted by means of the pressure reducing valve 26.

Return

When the drill feed cylinder 14 has advanced to its maximum extent it comes into contact with the mechanical front end stop 20. This opens the feed supply to the tank and, since the pressure in the feed circuit now drops off, the percussion also stops. The percussion control valve 48 was held in the closed position by the feed pressure and it therefore returns to a position at which the hydraulic fluid delivered by the percussion pump 52 is returned to the tank.

Rotation of the drill however continues. The drill is returned manually with the drill feed cylinder 14 by moving the lever of the feed control valve 38 to a forward position. The boom pump 56 supplies hydraulic fluid for rapid feeding. The anti-jamming feature, described hereinbefore, is operative during return motion and if the drill bit gets stuck during reverse movement of the drill feed cylinder, the direction of movement of the drill feed cylinder is immediately reversed and then returned when the rotation pressure decreases.

Percussion only

If percussion without rotation is required, for example during drill bit loosening, this can be achieved by moving the other lever of the feed control valve 38 forward so that hydraulic fluid from the shuttle valve 40 pressurizes the pilot line 42 and closes the tank connection with the percussion control valve 48 whereupon percussion starts. A light feed force can be applied simultaneously by pulling on the lever of the feed control valve 38.

It is apparent that through the use of the control circuit of the invention percussion does not commence unless the feed pressure activates the percussion control valve to close. Conversely the hydraulic fluid for the percussion is always on free flow when percussion is not required.

While drilling the valve 48, which is a normally open pilot-to-close valve cartridge, is fully closed and the percussion pressure is present to the predetermined maximum level with the valve 50. It follows that the operator can adjust the drilling feed pressure and force with the reducing valve 34 according to rock hardness and drilling penetration speed but can not adjust the percussion pressure on the drill while drilling, without losing the maximum drilling percussion power supplied from the drill.

It also follows that the operator cannot damage the drill by keeping the percussion on without drilling. The main control valve for percussion in the control panel, which is encountered in prior art devices known to the applicant is therefore not needed. The circuit has less hosing, is simpler and is easier to maintain. The training of operating and maintenance personnel is simplified.

The small and simple free flow control valve manifold 46 can be connected preferably directly to the pump or oil filter or the tank and, as has been indicated, the valve 48

We claim:

1. A control system for a percussion drill with a hydraulically actuated drill percussion mechanism, drill rotation mechanism and drill feed mechanism for a drill bit, which includes a control means which is activated, only in reaction to an increase in the hydraulic pressure in the drill feed mechanism or the hydraulic pressure in the drill rotation mechanism or both of these hydraulic pressures, due to contact of the drill bit against a rock face, to start a percussion movement of the drill.

2. A control system according to claim 1 wherein the control means operates only in reaction to the hydraulic pressure in the drill feed mechanism and, upon starting percussion movement of the drill, simultaneously starts rotary movement of the drill.

3. A control system according to claim 1 wherein the drill feed mechanism is a drill feed cylinder.

4. A control system according to claim 1 which includes a percussion mechanism, and pump means for supplying hydraulic fluid to the percussion mechanism, and wherein the control means is directly connected to the pump means.

5. A control system according to claim 4 wherein the pump means is a fixed displacement pump.

* * * * *